US005474668A

United States Patent [19]

Ackerson et al.

[11] Patent Number: 5,474,668

[45] Date of Patent: Dec. 12, 1995

[54] PETROLEUM-WAX SEPARATION

[75] Inventors: Michael D. Ackerson, Fayetteville, Ark.; Seyed-Hamid Arabshahi, Houston, Tex.; Robert E. Babcock, Fayetteville, Ark.

[73] Assignees: University of Arkansas, Little Rock; Advanced Refining Technologies, Inc., North Little Rock, both of Ark.

[21] Appl. No.: 279,801

[22] Filed: Jul. 25, 1994

Related U.S. Application Data

[63] Continuation-in-part of Ser. No. 17,024, Feb. 12, 1993, abandoned, which is a continuation-in-part of Ser. No. 653,626, Feb. 11, 1991, Pat. No. 5,196,116.

[51] Int. Cl.[6] ..... C10G 73/06

[52] U.S. Cl. ..... 208/33; 208/35

[58] Field of Search ..... 208/33, 35, 36, 208/37, 38

[56] References Cited

U.S. PATENT DOCUMENTS

| | | | |
|---|---|---|---|
| 1,956,780 | 5/1934 | Voorhees | 208/33 |
| 2,044,724 | 6/1936 | Govers | 208/36 |
| 2,049,059 | 7/1936 | Goss et al. . | |
| 2,067,050 | 1/1937 | Govers | 196/19 |
| 2,164,779 | 7/1939 | Manley . | |
| 2,191,136 | 2/1940 | Tijmstra et al. | 196/18 |
| 2,223,939 | 12/1940 | Jones . | |
| 2,229,658 | 1/1941 | Jenkins | 196/18 |
| 2,410,483 | 11/1946 | Dens et al. | 208/33 |
| 2,463,845 | 3/1949 | Backlund et al. . | |
| 2,486,014 | 10/1949 | Evans . | |
| 2,578,510 | 12/1951 | Clarke . | |
| 2,604,435 | 7/1952 | Clarke . | |
| 2,608,517 | 8/1952 | Tiedje . | |
| 2,625,502 | 1/1953 | Backlund et al. | 196/17 |
| 2,698,279 | 12/1954 | Mondria | 196/18 |
| 2,723,220 | 11/1955 | Axe . | |
| 2,880,159 | 3/1959 | Livingstone et al. | 208/31 |
| 2,904,496 | 7/1959 | Bloch et al. | 208/33 |
| 2,914,456 | 7/1959 | Moore et al. | 208/38 |
| 2,915,449 | 12/1959 | Doorn et al. | 208/29 |
| 3,011,972 | 5/1961 | Watson et al. | 208/264 |
| 3,041,268 | 6/1962 | Arabian et al. | 208/31 |
| 3,105,809 | 3/1963 | Butler et al | 208/31 |
| 3,239,445 | 3/1966 | Leonard et al. . | |
| 3,320,153 | 12/1967 | Pino | 208/33 |
| 3,627,673 | 1/1969 | Sproule et al. | 208/211 |
| 3,764,517 | 10/1973 | Bodemuller, Jr. . | |
| 3,773,650 | 11/1973 | Hislop et al. | 208/33 |
| 3,775,288 | 11/1973 | Eagen et al. | 208/33 |
| 3,871,991 | 3/1975 | Shaw | 208/33 |
| 3,966,586 | 6/1976 | Owen et al. . | |
| 3,972,802 | 8/1976 | Bushnell | 208/33 |

(List continued on next page.)

FOREIGN PATENT DOCUMENTS

| | | |
|---|---|---|
| 464175 | 4/1937 | United Kingdom . |
| 679173 | 9/1952 | United Kingdom . |
| 1311400 | 3/1973 | United Kingdom . |

*Primary Examiner*—Asok Pal
*Assistant Examiner*—Bekir L. Yildirim
*Attorney, Agent, or Firm*—Daniel R. Alexander; Head & Johnson

[57] ABSTRACT

A process for dewaxing including the steps of mixing a waxy feedstock near its pour point with an ambient or below ambient temperature solvent essentially free of a selected cosolvent, to form a solvent/feedstock mixture, essentially free of a selected cosolvent, and subsequently adding the cosolvent to the solvent/feedstock mixture to cause instantaneous precipitation of wax on addition of cosolvent with the amount of wax precipitation being controlled by the quantity and temperature of cosolvent added. The cosolvent is essentially completely miscible with the solvent, but immiscible with the oil and wax. For example, alcohols (methanol, ethanol, propanol), ketones (ketene, acetone), amines, etc. The process of the present invention provides the advantages of lower solvent ratios (higher solvent recovery), higher filtration temperatures, "environmentally compatible" solvents, rapid filtration rates, and debottlenecking of existing dewaxing plants.

7 Claims, 6 Drawing Sheets

U.S. PATENT DOCUMENTS

| | | | |
|---|---|---|---|
| 4,111,790 | 9/1978 | West | 208/33 |
| 4,115,241 | 9/1978 | Harrison et al. . | |
| 4,145,275 | 3/1979 | Hall et al. | 208/33 |
| 4,146,461 | 3/1979 | Broadhurst et al. . | |
| 4,199,433 | 4/1980 | Button et al. | 208/31 |
| 4,441,987 | 4/1984 | Broadhurst . | |
| 4,444,648 | 4/1984 | West | 208/33 |
| 4,447,311 | 5/1984 | Fowles et al. | 208/35 |
| 4,502,787 | 3/1985 | Broadhurst . | |
| 4,514,280 | 4/1985 | Shaw et al. | 208/33 |
| 4,673,484 | 6/1987 | Babcock et al. | 208/435 |
| 4,695,363 | 9/1987 | West . | |
| 4,728,413 | 3/1988 | Broadhurst | 208/33 |
| 4,898,659 | 2/1990 | Broadhurst | 208/33 |
| 5,006,222 | 4/1991 | Sequeira | 208/33 |
| 5,196,116 | 3/1993 | Ackerson et al. | 208/33 |

PETROLEUM-WAX SEPARATION

CROSS-REFERENCE TO RELATED APPLICATIONS

This application is a continuation-in-part of U.S. patent application Ser. No. 08/017,024, filed Feb. 12, 1993, now abandoned which is a continuation-in-part of U.S. patent application Ser. No. 07/653,626, filed Feb. 11, 1991, now U.S. Pat. No. 5,196,116, issued Mar. 23, 1993.

BACKGROUND OF THE INVENTION

The present invention relates to dewaxing of petroleum products and other heavy hydrocarbon mixtures. It also relates to similar processes for deoiling the waxes that are found in combination with heavy hydrocarbon mixtures. The present invention also relates to wax fractionation and the production of low pour point oils. It will be understood that when the term dewaxing is used herein it will also include other similar processes such as deoiling. Wax as used in the present description will include all compounds or mixtures to which the term wax is applied, both natural and synthetic, and also will include in general saturated hydrocarbon chain link compounds.

Crude petroleum and partially refined petroleum commonly contain waxes (usually paraffin waxes). Such waxes crystallize at low temperatures, and this is particularly notable with high molecular weight n-paraffins, certain iso-paraffins, and cycloparaffins.

When the petroleum is being refined for use as lubricating oil, the presence of these materials which crystallize within a range of temperatures for which the lubricating oil is intended is very deleterious. Such materials are therefore commonly removed in the refining process and this subprocess is referred to as dewaxing.

There is great variety in the processes used for dewaxing as it cannot be carried out as a normal consequence of the conventional fractional distillation process. The oldest and simplest form of dewaxing is chilling of the crude lubricating oil to about the desired pour point temperature causing crystallization of most of the wax components, after which they are physically removed by filtration or the like. This process is largely of historical interest because of its high cost and unsuitability for processing heavy oils.

The straight chilling process for dewaxing was improved by inclusion of an initial step of adding a relatively large proportion of solvent or diluent to the oil prior to the chilling process. Early types of diluents used in this solvent dewaxing process were heavy naphtha or gas oil. In recent years a great variety of solvents have been employed in conjunction with the chilling step to endeavor to increase efficiency and otherwise improve results.

it was found that somewhat better solvent-chilling dewaxing results were achieved with a mixture of two solvents and thus various mixtures of two different solvents have been employed as dewaxing solvents. Perhaps the most frequently used dewaxing solvent mixture has been a mixture of methyl ethyl ketone (MEK), toluene, and benzene. A common dewaxing solvent mixture may contain 25% to 50% of MEK, 40% to 60% of benzene, and 12% to 25% of toluene. Sometimes ketones of higher molecular weight have been used in place of MEK. This permits one to obtain a higher solvent power for heavy oil. In some solvent-chilling dewax operations the high crystallization temperature (about 5° C.) of benzene has caused toluene to be substituted for the benzene so that the diluent is essentially a mixture of MEK and toluene.

A common solvent-chilling dewax process may proceed as follows. The solvent may be an MEK/benzene or an MEK/toluene combination. After the solvent is added to the oil charge to form a mixture, the mixture is normally heated slightly to Insure complete solution of wax components. The mixture is then chilled to the required filtration temperature, usually on the order of −20° C. utilizing a conventional refrigeration process. Refrigeration is typically carried out by pipe-in-pipe type heat exchangers (scrape-surface heat exchangers) with the solvent and waxy oil in the inside pipe and a refrigerant such as propane or sulfur dioxide in the annular space between the two pipes. The surface of the inner pipe must be kept free of wax by scraper blades to maintain adequate heat transfer. The wax is removed by filtration under vacuum in conventional rotary filters in a well known manner.

There are other processes for solvent-chilling dewaxing, such as propane dewaxing in which a single effective constituent is present in the solvent. Propane dewaxing has certain advantages in that it may be a follow-on to propane deasphalting, thereby eliminating a propane-oil separation step between the stages of the process. A disadvantage of propane dewaxing is that the required dewaxing temperatures are generally lower.

In light of the foregoing, there is a need for an improved, simplified and economical petroleum-wax separation process which provides for the effective dewaxing or deoiling of waxy feedstocks.

SUMMARY OF THE INVENTION

In accordance with the present invention a sequential solvent and cosolvent petroleum-wax separation process provides for dewaxing of waxy feedstocks, for example, lube oil, raffinates, resids, or slack wax, deoiling, wax fractionation, and the production of low pour point oils. In accordance with one embodiment of the present invention, the dewaxing process does not require chilling of the solvent, cosolvent, feedstock, or mixtures thereof below normal ambient temperature for crystallization of and precipitation of the wax. However, in accordance with other embodiments of the present invention the dewaxing process is carried out in a dewaxing system including refrigeration apparatus and includes a chilling step.

The dewaxing process of the present invention involves two separate dilution steps or solvent addition steps with two distinctly different solvents. Hereinafter the first solvent will be referred to as the primary solvent, or simply the solvent, and the second solvent will be referred to as the cosolvent (or selected cosolvent). The term "cosolvent" as used herein will have a specially defined meaning, not to be confused with various meanings for cosolvent which may be found in other contexts.

The second solvent, or the "selected cosolvent" as it will be termed, is selected from a group of chemical compounds, for example, alcohols, ketones, and amines, which are essentially completely miscible with the solvent, but immiscible with the wax, and in the liquid state at or above room temperature (at a pressure of less than ten atmospheres). In this discussion, room temperature will be understood to be a rather wide range of temperatures about 20° C. (68° F.) plus or minus 10° C. (18° F.). Also, it is preferred that the cosolvent be essentially immiscible with the oil and significantly miscible with water.

The group from which the selected cosolvent is taken is preferably the group of alcohols having a molecular composition with a low carbon number, preferably of three or less, and having one oxygen atom plus an even number (2–8) of hydrogen atoms. Specifically these compounds are: methanol, ethanol, propanol, and isopropanol. The above four compounds have the physical characteristic of total miscibility with light-to-intermediate (herein defined as C number of less than fourteen) hydrocarbons, tertiary ethers, dimethyl carbonate, and water. At the same time, they have low solubility for waxes.

In the process according to the present invention, the requirements for the primary solvent are not very strict and most light-to-intermediate hydrocarbons known and commonly used as solvents may be employed alone, or in admixture, for the primary solvent. In accordance with a preferred embodiment of the present invention, the primary solvent is selected from a group of tertiary ethers including MTBE, TAME, ETBE, and esters of carbonic acid such as dimethyl carbonate. The primary solvent should not contain more than twenty-five percent of the selected cosolvents described above. Admixture of the cosolvent with the solvent before addition to the petroleum feedstock substantially destroys the effectiveness of the selected cosolvent in crystallizing and precipitating the wax components from the feedstock/solvent mixture.

Where the process according to the invention is directed to dewaxing a petroleum feedstock to obtain an end product with sufficiently low residual wax content for high quality lubricating oil, this can be accomplished, if desired, in a single stage of steps of primary solvent dilution, selected cosolvent dilution, precipitation and filtering. Of course, a practical industrial process normally involves a closed loop system for recovery and reuse of solvents and cosolvents, as will be more fully explained hereinafter.

There are two desirable objectives in the separation of wax from petroleum or other hydrocarbons, one of which is obtaining a high quality lubricating oil with minimal residual wax content as previously described. The other advantage to be obtained is to maximize the potential value of the recovered waxes themselves. Waxes are used in a great many industrial processes for wax coating paper or paperboard products and other uses too numerous to mention. High quality waxes are also a component of numerous consumer products. In general, the desirability and hence the value of waxes is directly related to their high melting or softening temperature which is in turn related to their high molecular weight. The process according to the present invention can be carried out in a manner to provide fractionation so as to separately recover waxes of highest value, thereby inexpensively producing a by-product capable of substantially contributing to the profitability of the overall operation. The process when carried out in this form is still capable of further removal of the waxes of lower molecular weight (and generally lower value) substantially in their entirety to produce a nearly wax-free lubricating oil of high quality.

In accordance with an embodiment of the present process used to maximize the value of recovered waxes, the selected cosolvent diluent is added in at least two different stages rather than in one stage. It has been found that reducing the amount or proportion of the selected cosolvent diluent has two effects. One is that the quantity of wax precipitated is reduced. The other effect is that the wax produced is of a higher average molecular weight and higher melting point, and thus has substantially higher potential value. These higher value waxes are removed in a conventional filtering process and may be further deoiled by additional washing with the same or similar solvents. The value of the wax recovered in this form of the process is quite high and may be on the order of $1.00 a pound. Following the recovery of the high molecular weight wax, the filtrate is transported to a second stage of selected cosolvent dilution, generally with little or no further treatment of the filtrate. At this point the filtrate contains the original petroleum feedstock with the residual wax that has not been removed, the added primary solvent, and a limited proportion of the selected cosolvent.

With the addition of a greater quantity of selected cosolvent, it has been found that additional quantities of wax in the solution will crystallize and precipitate allowing them to be removed by a physical process such as filtration. The addition of water at this point will aid in completing the wax crystallization process. Still further crystallization may be induced by the use of brine with or in place of the water, but certain disadvantages accruing from brine introduction make this generally a less preferable variation of the process. If desired, substantially complete removal of waxes can be accomplished in the second stage or the wax removal can be divided into still more stages of selected cosolvent (possibly with water) dilution, precipitation, and filtration, each stage having a wax product produced with lower molecular weight and lower melting point than the previous stage.

In accordance with one embodiment of the present process, refrigeration or cooling by artificial means is not required, thereby greatly simplifying the process and greatly reducing the expense of this essential aspect of petroleum refining. In accordance with another embodiment of the present petroleum-wax separation process, selected solvents and cosolvents can be used in separation apparatus including conventional refrigeration and cooling means. In accordance with yet another embodiment of the present process, wax precipitation is facilitated by evaporative cooling involving evaporation or absorption of at least some of the solvent, cosolvent, or both. Such evaporation is accomplished, for example, by a change in pressure across a filter unit, a vacuum drawn on the feedstock/solvent/cosolvent mixture or a filtrate (adiabatic flash), or an absorption of solvent or cosolvent by an inert gas (adiabatic stripper). Evaporative cooling enhances the wax-oil separation by reducing the filtration temperature without requiring the use of conventional scrape-surface heat exchangers.

In accordance with one aspect of the present invention, a process for separating oil and wax from a waxy feedstock includes an evaporative cooling step involving a vaporization of cosolvent into an inert gas, such as, nitrogen. More particularly, the evaporative cooling step involves the passing of an inert gas through the feedstock/solvent/cosolvent slurry. As a result of the presence of the inert gas, some of the cosolvent (and small quantities of solvent) will be vaporized. When this process is carried out adiabatically (no heat added or removed), the temperature of the slurry will drop resulting in additional wax precipitation (crystallization). The final slurry temperature can be controlled by controlling the amount of cosolvent evaporated. This can be adjusted by varying the nitrogen flow rate, column height, etc.

This evaporative cooling step can be carried out prior to the first filtration, resulting in a fully dewaxed oil in the first step. Alternatively, the evaporative cooling can be carried out after a first filtration in which the high melt waxes are removed so that the resulting filtrate is cooled and refiltered to remove the low melt waxes and produce a lube oil of low pour point. After some of the cosolvent has been evaporated into the inert gas stream it must be recovered from the gas. This can be accomplished by either using a cooler (condenser) or reabsorbing the cosolvent into fresh feed.

Some of the advantages of the present process include lower solvent ratios, higher filtration temperatures, environmentally compatible solvents (tertiary ethers, dimethyl carbonate, and alcohols), rapid filtration rates, less overall refrigeration, and potential for debottlenecking lube operations.

In accordance with one aspect of the present invention, environmentally compatible solvents and cosolvents such as MTBE, ETBE, TAME, dimethyl carbonate, and alcohols are used in place of MEK, toluene and acetone. These environmentally compatible oxygenated solvents and cosolvents allow existing lube plants and dewaxing operations or facilities to continue to be operated without modification or with minor modifications for splitting the solvent and cosolvent for reuse.

In addition to providing the features and advantages described above, it is an object of the present invention to provide a solvent dewaxing process for substantially complete dewaxing of crude or partially refined petroleum.

It is another object of the present invention to provide a dewaxing process for liquid or amorphous heavy hydrocarbons in which two distinctly different diluents are used sequentially with the second of such diluents being a selected cosolvent consisting essentially of one or more ketones, alcohols or organic acids with a carbon number of three or less, and the first of the diluents being any one or more of a general class of commonly used solvents or octane enhancers except that such primary solvent contain no more than twenty-five percent of such selected cosolvents.

It is yet another object of the present invention to provide a petroleum wax separation process for waxy feedstocks in which two distinctly different diluents are used sequentially in the process, the first of such diluents being either a tertiary ether or a dimethyl carbonate and the second diluent being an alcohol.

It is still another object of the present invention to provide a process for separating wax from a liquid or amorphous hydrocarbon mixture including two steps of adding controlled amounts of selected cosolvents consisting essentially of one or more alcohols, ketones, or organic acids with a carbon number of three or less, the first quantity of such cosolvent being limited to cause crystallization and precipitation of only high molecular weight, high melting point waxes, while the second quantity of selected cosolvent is sufficient to crystallize and precipitate substantial quantities of lower molecular weight waxes.

It is yet another object of the present invention to provide a process for separating wax from a waxy feedstock or waxy feedstock/solvent mixture including the step of evaporatively cooling the solvent, cosolvent, feedstock/solvent mixture, feedstock/solvent/cosolvent slurry, filtrate, or solvent/cosolvent mixture by evaporating or absorbing some of the solvent or cosolvent.

It is still another object of the present invention to provide a deoiling process for waxes recovered from liquid or amorphous hydrocarbon mixtures producing high quality wax of high molecular weight wherein a quantity of selected cosolvent is added to a liquid hydrocarbon mixture at room temperature or above and crystallized wax is thereby precipitated, after which it is recovered by filtering and washed with a liquid including the same selected cosolvent to further remove residual oil from the wax after which the washing cosolvent is separated from the high quality, high molecular weight wax by filtration or evaporation.

It is yet another object of the present invention to provide a petroleum wax separation process producing low pour point oils.

It is still yet another object of the present invention to produce high normal paraffin content waxes with narrow carbon distributions.

Other objects and advantages of the present invention will be apparent from consideration of the following description in conjunction with the accompanying drawings wherein like parts are designated by like reference numerals.

DETAILED DESCRIPTION OF THE PREFERRED EMBODIMENTS

Figure 1:
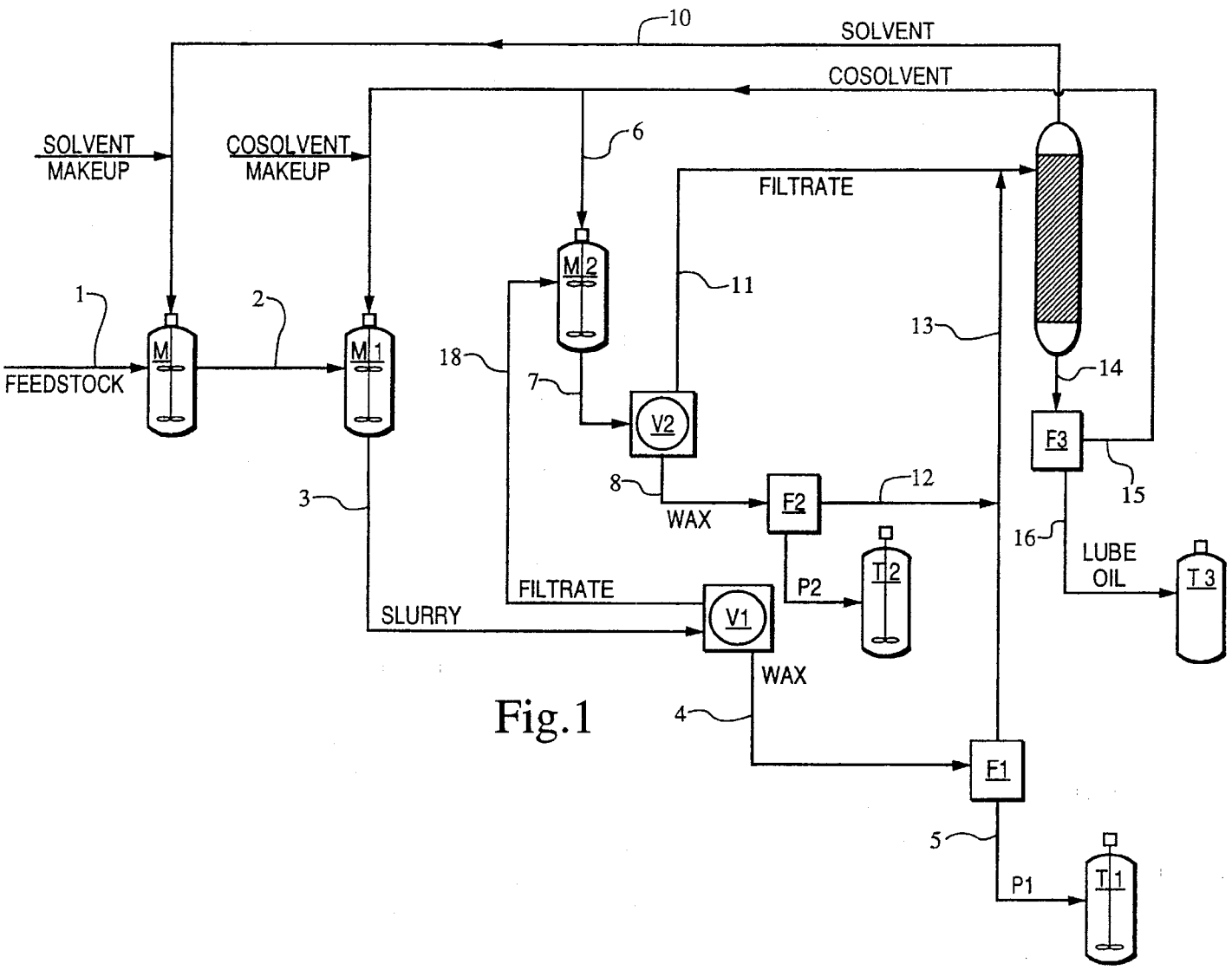
FIG. 1 is a schematic illustration of apparatus and process of petroleum wax separation at or above room temperature according to one embodiment of the invention.

In accordance with one embodiment of the present invention, the petroleum wax separation process provides for dewaxing with or without integral deoiling, stand alone deoiling, and wax fractionation, all of which can be carried out at or near ambient temperatures, depending on the product or products desired, without requiring the use of scraped-surface heat exchangers or scraped-surface chillers. The present process involves bringing a waxy feedstock (distillate, raffinate, slackwax, resid, gas oil, lube oil, etc.) at or slightly above its pour point into contact with ambient, near ambient, or below ambient temperature solvent and achieving a homogeneous solution or feedstock/solvent mixture having a pour point below that of the feedstock. Mixing may be achieved by any of several methods, however, simple static mixers are usually more than sufficient. After mixing, the solvent/feedstock feedstock mixture is well below the pour point of the original waxy feedstock. The solvent selection is not too critical. There are a large number of solvents that will work. The solvent should be chosen such that the oil and all or most of the wax are soluble at ambient temperature. The amount of solvent used should be kept low for economic reasons and this can gave an impact on the solvent selection. The solvent/feedstock ratio in general is around 0.5/1.0 by weight, however, it can be higher or lower depending on the feedstock and the product or products desired. Solvent selection can come from several classes of compounds, for example; paraffins, aromatics, chlorinated compounds, and oxygenated compounds (MEK, MIBK, ethers, MTBE, TAME, ETBE, esters of carbonic acid, dimethyl carbonate, higher alcohols, etc.) The solvent can also be selected from any of the dewaxing solvents known in the prior art such as the aliphatic ketones having from three to six carbon atoms, e.g., acetone, methylethyl ketone (MEK), methylisobutyl ketone (MIBK) especially when warm and the like, the lower molecular weight hydrocarbons such as propylene, and aromatics such as benzene and toluene. In addition, halogenated low molecular weight hydrocarbons such as the $C_2$–$C_4$ chlorinated hydrocarbons, e.g., dichloromethane, dichloroethane and mixtures thereof, may be used. Specific examples of solvents include toluene, MIBK, MEK/Toluene, MEK/MIBK, and the like. However, virtually anything that allows for a homogeneous solution at the mixing temperature will work.

After the solvent and feedstock have been mixed, the solvent/feedstock mixture is mixed with a cosolvent to form a feedstock/solvent/cosolvent slurry. The term "slurry" as used herein will refer to the feedstock/solvent/cosolvent mixture which is usually a predominantly liquid mixture containing some solids in the form of crystallized and/or precipitated wax. The key to the present process is the successive addition of a cosolvent, in one or more steps. Cosolvent selection is critical and of greater importance than the solvent. The cosolvents are any compounds that are essentially immiscible with the wax at and below the mixing temperature. The cosolvents are preferably essentially immiscible with the oil, but miscible with the oil/solvent mixture. In addition, most of the cosolvents that work well have significant (almost total) miscibility with water. The following cosolvents are specifically mentioned: alcohols (methanol, ethanol, propanol, isopropanol), ketones (ketene, acetone, MEK and MIBK if cold), amines, ethers and aldehydes, However, this list is not complete and exhaustive, but simply illustrative. The importance in cosolvent selection is to meet the criteria set forth above.

If the solvent, feedstock, and cosolvent are simultaneously mixed in the ratios used by this process (solvent/feedstock/co-solvent ratios are about 1.0/0.5/2.0 by weight when using Texaco 325N raffinate as feedstock) at the elevated mixing temperature of a conventional MEK/toluene process, two liquid phases may result. The wax will be removed from solution, but it will be liquid at the high mixing temperatures. As a liquid, it will have a high oil solubility and the process does not work. In order to prevent problems of a liquid wax/oil phase forming, the solvent used should be relatively low in cosolvent contamination because of the higher mixing temperature of the solvent/feedstock mixture. Solvents containing up to ten percent cosolvent by weight are not usually a problem, but contamination much higher than twenty-five percent may cause problems with some feedstocks, particularly slack waxes.

The cosolvent can be added at ambient or near ambient temperature or chilled well below ambient temperature depending on the feedstock and the desired product or products. As the cosolvent is added to the solvent/feedstock mixture, wax immediately precipitates from the solution. The amount of wax removed is controlled by the cosolvent chosen (and to a limited extent, the solvent chosen), the amount of cosolvent used (solvent/cosolvent ratio, solvent/feedstock ratio), and by the temperature of the resulting mixture. The process carried out in this fashion is an equilibrium process, not a rate based process. In general, when attempting to achieve a low pour oil, if the ratios of solvent and cosolvent are chosen carefully, a pour point can be obtained which is well below the filtration temperature. Pour points 30° F. below filtration temperature are typical and with some optimization, 40° to 45° F. below filtration temperature can be obtained. In order to achieve lower pour oils, the slurry that has formed after the cosolvent addition may be chilled further by use of some means of solid-surface heat exchange, by evaporative cooling (absorptive cooling or auto refrigeration), or by addition of cold cosolvents or solvents.

When wax precipitation is carried out by this process, the first waxes to precipitate are very high in normal paraffins. By sequentially adding limited amounts of cosolvent, very high normal paraffin content (ninety-five percent or greater) waxes with narrow carbon distributions (five carbons or less) and narrow melting point ranges (plus or minus five °F. or less) can be produced by this process. Thus, the process can be used as a wax fractionation process. Also, the oils produced by this process may have some enhanced properties.

Water may have a significant effect on the process by acting as a second cosolvent. The water is miscible with the cosolvents and, if added to the solvent/feedstock/cosolvent slurry, it will act to enhance the cosolvent action and remove more wax from solution. The amount of water must be controlled to prevent the formation of separate water/cosolvent and oil/wax/solvent liquid phases.

Some of the advantages of this process are: use with or without scraped-surface exchangers and scraped-surface chillers; lower solvent ratios; higher filtration temperatures; "environmentally compatible" solvents; rapid filtration rates and less overall refrigeration. As a result of elimination of scraped-surface exchangers and higher filter rates from higher filter temperatures, the process provides for debottlenecking lube operations.

Because the crystal formation in this process is an equilibrium process, not a rate based process such as the heat transfer based refrigeration process used by conventional dewaxing technology, the crystal structure is likely different. Crystals formed by the present process appear to have structural advantages which allow for more rapid filtration. In addition to the structural differences, the higher filtration temperatures of the present process allow for more rapid filtration rates. Filtration rates of 10 gal/hr $ft^2$ (based on oil feed) have been obtained using only 5 inHg vacuum on a conventional rotary vacuum filter.

Some means of refrigeration can be used to chill the solvent or cosolvent streams which can be used as cold dilution solvent at the mixers or for other temperature control. Refrigeration can also be used to cool or condense various vapors (such as solvent or cosolvent vapors from the vacuum system). In addition, cold solvents or cosolvents can be obtained by cross exchanging the solvents or cosolvents with cold filtrate.

As shown in FIG. 1 of the drawings, a waxy feedstock enters the process at 1 where it is mixed in a conventional mixing tank M with a primary solvent. By way of example only, the feedstock may consist of waxy heavy vacuum gas oil and the primary solvent, for example methyl tertiary butyl ether (MTBE), may be in ratio of 2:1 by weight to the feedstock. Unless otherwise stated all proportions herein are proportions by weight.

The primary solvent provided through line 10 and the feedstock provided through line 1 are mixed in mixing tank M to obtain a homogeneous solution. This step may be facilitated by heating the feedstock or solution to a temperature above ambient temperature, up to about 120° F. (or 48.9° C.). The output from mixing tank M is supplied through line 2 to mixing tank M1 where it is mixed with a selected cosolvent, for example methanol, the ratio of methanol to feedstock being 3:8 in this example, it should be noted that the primary solvent may include commonly used solvents other than MTBE, but it should not contain significantly more than twenty-five percent of the selected cosolvent, methanol.

The temperature of the mixing tank M1 and contents is not critical but will normally be slightly above ambient temperature, in this example 78° F. (or 25.6° C.). The addition of the selected cosolvent in the mixture of mixing tank M1 spontaneously produces crystallization of a high melt fraction of the wax content of the feedstock. The relatively low ratio of cosolvent to feedstock causes only high molecular weight, high melt temperature wax crystals to form. The wax crystals precipitate from the solution, and this slurry is fed through line 3 to a conventional vacuum filter apparatus V1. Exiting the vacuum filter apparatus V1 through line 4 is a wax product, at this point comprising a waxy slurry which is conveyed through line 4 to a solvent evaporation step at F1 which may be performed by a conventional flash evaporation or distillation apparatus.

From F1, the removed wax product P1 is conveyed through line 5 to product P1 storage tank T1. Although product P1 may be further washed or refined, such steps are conventional and not shown in FIG. 1 for simplicity and clarity. Product P1 in storage tank T1 may be heated and mildly agitated to prevent solidification pending further processing thereof.

The evaporated feedstock, primary solvent, and cosolvent from flash evaporator F1 is supplied to distillation column C through line 13. As will be more fully explained hereinafter, the process flow diagram of FIG. 1 includes solvent and cosolvent recovery steps which are necessary for a practical system, although they are not a critical feature of the present invention. In this regard, it may be desired to select the chemical compounds utilized for the primary solvent (or solvents) and the selected cosolvent (or cosolvents) with a view to ease of separating them in the recovery process. As previously explained, this separation is necessary particularly from the point of view of eliminating an amount of selected cosolvent significantly greater than twenty-five percent of the primary solvent make up. In the example being described, the selected cosolvent methanol has a higher boiling point than the primary solvent MTBE, thus making virtually complete separation of the cosolvent and primary solvent easy to accomplish in a conventional distillation column.

Considering now the filtrate from rotary vacuum filter V1 which is now at a lower temperature due to the effects of the first vacuum filtration, it is supplied through line 18 to a mixing tank M2. Thus, the filtrate from the first stage may be used essentially without further treatment in a second stage of wax separation. An additional quantity of selected cosolvent is supplied through line 6 to mixing tank M2. The quantity of additional cosolvent for the second stage will normally be equal to or greater than the amount of cosolvent for the first stage. In the present example, the additional selected cosolvent in the second stage is double that of the first stage. That is, the ratio of second stage cosolvent to original feedstock is 3:4. The process flow for the second stage proceeds substantially the same as for the first stage with the slurry output of mixing tank M2 passing along a line 7 to a rotary vacuum filter V2 having a wax product output along a line 8 to a solvent flash unit F2, which evaporates the residual oil, solvent and cosolvent from the wax product into line 12 arid on to distillation column C via line 13. The wax product P2 of flash unit F2 proceeds through line 9 to product P2 storage tank T2 in the same fashion as with product P1 and tank T1. The filtrate output of vacuum filter V2 passes along line 11 to distillation column C.

Dewaxed feedstock (oil) is transferred through line 14 from the recovery distillation column C to a flash evaporator F3 in which the cosolvent is flashed and transported through line 15 to be recycled while the dewaxed lube oil product is fed through line 16 to a lube oil storage tank T3. Solvent is transferred along line 10 from the distillation column C to mixing tank M. The recycled solvent should contain twenty-five percent or less cosolvent contamination.

The solvent in line 10 can be cooled or chilled, by for example, cross-exchange with the filtrate in line 11, evaporative cooling, or refrigeration, to provide cold solvent injection in mixing tank M. Likewise, the cosolvent in line 15 can be cooled or chilled to provide cold cosolvent injection in mixing tanks M1 and M2.

The number of stages of wax separation is not limited to two and additional stages may be employed. For example, a third stage may add an additional quantity of selected cosolvent (methanol) equal to that added in the second stage. In the third stage the vacuum filtered wax cake may be washed with a 1:1 MTBE/methanol wash in a quantity of two and two-thirds of the amount of methanol added in the third stage. The filtrate from the third stage and the oil/solvent and cosolvent from the flash evaporator would be returned to the recovery distillation column C in the same manner as for the second stage. Still further stages of wax separation could be employed and the number of stages will generally be determined with a view to economic factors which are subject to wide variation. Based on experiments and calculations, excellent yield of different qualities of wax can be obtained.

As previously explained in part, solvent and cosolvent recovery is provided for in the process flow diagram of FIG. 1. In the example given, the cosolvent methanol has a higher boiling point than the solvent MTBE and this will be the case when using MTBE as the solvent and an alcohol such as methanol, ethanol, propanol or isopropanol as the cosolvent. When using a solvent having a higher boiling point than the cosolvent, the distillation column C would have separate cosolvent and solvent/oil outputs. Distillation column C obtains virtually complete separation of the selected solvent and cosolvent so that solvent line 10 has no significant amount of selected cosolvent.

The following yields can be expected in a system corresponding to the process flow diagram of FIG. 1. With a feedstock of from 25% to 30% wax content one may expect a yield of approximately 5% (by weight) of high melting point wax (congealing point 172° F.) from stage 1 (P1), and a yield of approximately 8% of feedstock weight of an intermediate melting point wax (congealing point of about 160° F.) from stage 2 (P2). In a third stage as described, low melting point waxes will be recovered with an expected quantity of about 12% of original feedstock weight, and a low melting point (congealing point of about 135° F.).

It should be particularly noted that contrary to most prior dewaxing systems, the present system allows the waxes to be recovered in separate stages characterized by different melting points, and thus different values. In most prior systems, it was necessary to conduct further processing of removed wax to separate desirable waxes of high value from those of little or no value. As seen from the above description, the separation of waxes is accomplished within the dewaxing process itself according to the present invention.

The process according to the present invention is subject to wide variation not limited to the following examples. For clarity and definiteness certain terms will be considered to have special meaning for the purpose of this description and claims. Light-to-intermediate hydrocarbon will mean a hydrocarbon with a C-number of thirteen or less. Dewaxing will mean any process for separation of wax from oil or vice-versa. Oil will mean any liquid or amorphous hydrocarbon, natural or synthetic. Wax will mean any compound or mixture to which the term wax is applied, natural or synthetic. Cosolvent will mean a solvent in which the feedstock/solvent mixture is soluble but which promotes separation of wax from the feedstock. Room temperature means a range of temperatures of 20° C. (68° F.) plus or minus 10° C. (18° F.). Liquid will mean any material which enters a liquid state at ambient temperature and at a pressure of ten atmospheres or less.

The following examples of processes according to the above-described embodiment of the present invention with specific materials, quantities, times, temperatures and other parameters should be considered to be illustrative and not restrictive of the scope of the present invention.

EXAMPLE 1

Example of multi-stage dewaxing or deoiling to sequentially and selectively remove wax fractions. Two hundred parts of a waxy heavy vacuum gas oil (feedstock) is mixed with four hundred parts of toluene (solvent) and gently heated until a homogeneous solution is obtained. The mixture is allowed to cool to 78° F. (25.6° C.). In a first stage, seventy-five parts of acetone (cosolvent) is added to precipitate a high melt fraction of wax crystals. The mixture is filtered by vacuum filtration and the wax cake product is washed with forty parts of a toluene/acetone mixture having a ratio of toluene/acetone of 5:1. After the cake is heated to remove any solvents or cosolvents and weighed, a yield of eleven parts of wax with a congealing point of 172° F. (77.8° C.) is measured.

The filtrate from the first stage, its temperature having dropped to around −3° C. because of the vacuum filtration, is used in a second stage which removes additional wax. In the second stage an additional one hundred fifty parts of acetone is added to the filtrate from the first stage and additional wax precipitates. The mixture is vacuum filtered and washed with one hundred fifty parts of a toluene/acetone mixture having a ratio of toluene/acetone of 2:1. After the wax cake is heated and weighed, a yield of fifteen parts of wax is measured with a congealing point of about 160° F. (71.1° C.).

The filtrate from the second stage is used in a third stage, its temperature having dropped an additional 10° C., to remove additional wax. In the third stage an additional one hundred fifty parts of acetone is added to the filtrate from the second stage and additional wax precipitates. The mixture is vacuum filtered and the wax cake is washed with one hundred parts toluene/acetone having a ratio of 1:1. After the wax cake is heated and weighed, a yield of twenty-four parts of wax with a congealing point of about 135° F. (57.2° C.) is measured.

EXAMPLE 2

This is an example of a dewaxing of heavy vacuum gas oil to produce a wax and low pour point oil suitable for lube oil stock. Twenty parts of toluene (solvent) are mixed with ten parts of heavy vacuum gas oil feedstock and gently heated. The mixture is then allowed to cool to about 78° F. (25.6° C.). Thirty-six parts of acetone (cosolvent) are added and within minutes a wax precipitate forms. After adding the acetone, approximately one part of water (secondary cosolvent) is added to the mixture and additional wax precipitates. The wax is recovered by vacuum filtration and wax amounting to about seven parts by weight is obtained. The solvents are removed from the filtrate by flashing at about 232° C. (450° F.) maximum and an oil product is obtained having a pour point of approximately 45° F. (7.2° C.).

EXAMPLE 3

Two hundred parts of a waxy heavy vacuum gas oil (feedstock) is heated to about 120° F. (48.9° C.) and mixed with four hundred parts of cold toluene (solvent) at about 30° F. (−1.11° C.) to form a homogeneous solution at about 78° F. (25.6° C.). In a first stage, seventy-five parts of acetone (cosolvent) at about 78° F. (25.6° C.) is added to precipitate a high melt fraction of wax crystals. The mixture is filtered by vacuum filtration and the wax cake product is washed with forty parts of a toluene/acetone mixture having a ratio of toluene/acetone of 5:1. After the cake is heated to remove any solvents or cosolvents and weighed, a yield of eleven parts of wax with a congealing point of 172° F. (77.8° C.) is measured.

In accordance with another aspect of the present invention, the petroleum wax separation process is enhanced using evaporative cooling, that is cooling by evaporation of some of the cosolvent or solvent depending on the particular solvent/cosolvent combination. The term evaporative cooling as used in the present application refers to cooling by evaporating solvent or cosolvent by, for example, a change it pressure across a vacuum filter, auto refrigeration by pulling a vacuum on the filtrate from a first vacuum filter before it passes to a second vacuum filter using an adiabatic flash and recirculating cold solvent or cosolvent, or absorbative cooling by using an adiabatic inert gas (nitrogen) stripper to cool the filtrate as it passes from one vacuum filter to another vacuum filter. Usually, in the context of the present invention, evaporative cooling is effected by evaporating one of the solvent or cosolvent. For example, when using MTBE as a solvent and methanol as a cosolvent, evaporative cooling is effected by evaporating the solvent MTBE. This also applies when using MTBE as a solvent and ethanol, propanol, or isopropanol as the cosolvent, and when using ethyl tert-butyl ether (ETBE) as a solvent and, either ethanol, propanol, or isopropanol as cosolvent.

When, however, using a heavier solvent, such as tetra loral amil ether (TAME) with a lighter cosolvent such as methanol, ethanol, propanol, or isopropanol, evaporative cooling is effected by evaporating some of the cosolvent. Although most of the examples described below accomplish evaporative cooling by evaporating cosolvent, it is to be understood that when using a lighter solvent than cosolvent, for example, MTBE or ETBE, with ethanol, propanol, or isopropanol, it is the solvent that is evaporated and recycled through the process to effect the desired cooling. Also, evaporative cooling could be effected by evaporating at least some of both the solvent and cosolvent.

Figure 2:
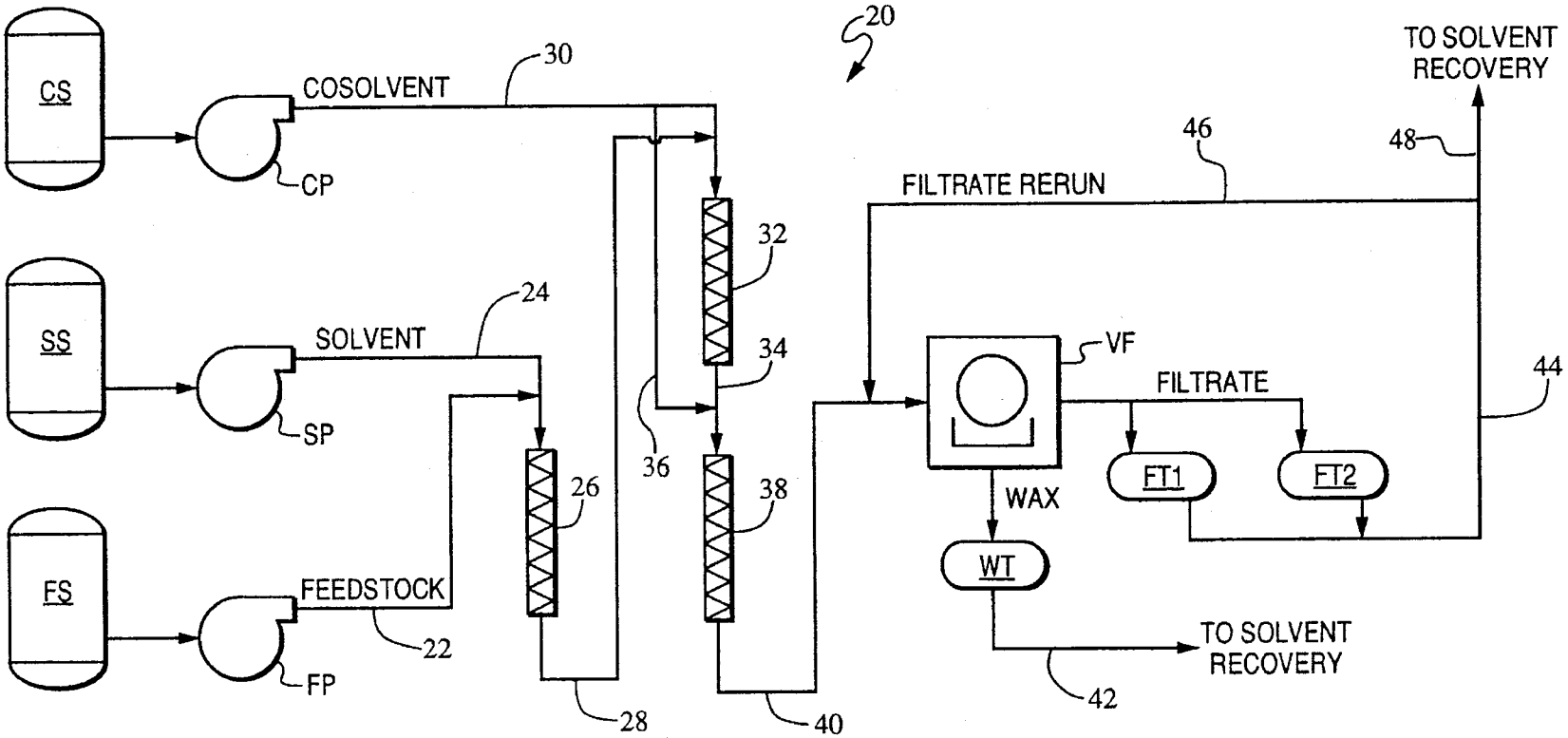
FIG. 2 is a schematic representation of apparatus and process of petroleum wax separation including recirculation of cold filtrate according to another embodiment of the invention.

As shown in FIG. 2 of the drawings and in accordance with another embodiment of the present invention, evaporative cooling involves the recirculation or return of a relatively cold filtrate which is added to the feedstock/solvent/cosolvent slurry input to a vacuum filter so as to reduce the temperature of the slurry and thereby enhance wax precipitation and removal. The evaporative cooling dewaxing system and process is generally designated by the reference numeral 20 and shown to include a supply of waxy feedstock FS, a supply of solvent SS, and a supply of cosolvent CS, each having a respective outlet leading to feedstock, solvent and cosolvent pumps, FP, SP and CP. The waxy feedstock and solvent are fed along lines 22 and 24 to a first static mixer 26 having a feedstock/solvent mixture output which passes along line 28 and is combined with cosolvent from line 30 in a second static mixer 32.

The feedstock/solvent/cosolvent slurry output of static mixer 32 passes along a line 34 and is combined with additional cosolvent via a line 36 before being input into a third static mixer 38. The feedstock/solvent/cosolvent slurry output of the third static mixer 38 passes along a line 40 and is input to a rotary vacuum filter VF. The wax output of the vacuum filter VF is fed to a holding tank WT and then fed via line 42 to solvent recovery such as flash evaporation or a distillation column to remove the solvent and cosolvent from the waxy cake. Typically, the wax cake can contain up to fifty percent moisture, and as such, needs to be processed to remove the solvents and cosolvents therein.

The filtrate output of vacuum filter VF is fed to two holding tanks, FT1 and FT2, having their outputs combined and transferred along a line 44 to either be recycled and thereby added to the incoming slurry upstream of vacuum filter VF through a line 46 or passed directly along line 48 to solvent recovery such as a distillation column wherein the solvent and cosolvent are separated and recycled by, for example, being added to the solvent supply SS and cosolvent supply CS.

The cold filtrate in line 46 which is added to the slurry in line 40 just upstream of the vacuum filter VF serves to dilute the solids in the slurry and, as such, adjusts the fluid content of the slurry for maximum effective filtration in vacuum filter VF and, also, to utilize evaporative cooling, that is the reduction in temperature created by the drop in pressure in the vacuum filter VF to enhance wax precipitation and filtration. The filtrate in return line 46 is colder than the slurry in line 40 and, as such, serves to cool the slurry and enhance wax removal. Although only a single filtration step and vacuum filter is shown in FIG. 2, it is to be understood that sequential filtrations can be performed with sequential additions of cold filtrate, solvent, cosolvent, and/or water to enhance wax precipitation and removal.

EXAMPLE 4

Heavy vacuum gas oil is mixed with one part MTBE and then 0.5 parts ethanol. As a result of the ethanol addition a wax slurry is formed (75° F.). Then, an equal amount of cold filtrate, 45° F., is added to the slurry and the resulting slurry is fed to the filter at 60° F. The wax is stripped of all solvents by evaporation and the congeal is 132° F.

Figure 3:
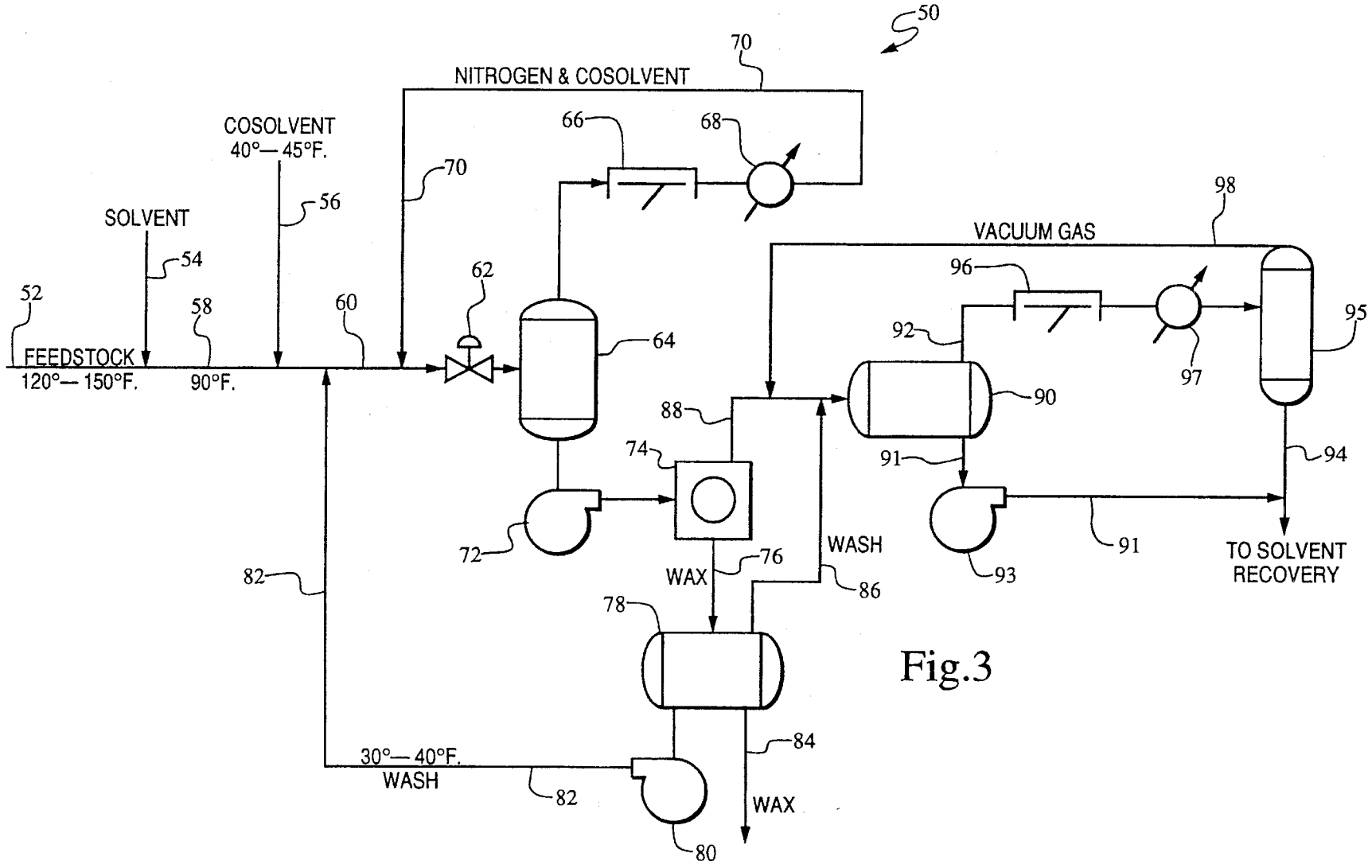
FIG. 3 is a schematic illustration of apparatus and process of petroleum wax separation including evaporative cooling (auto refrigeration) according to still another embodiment of the invention.

In accordance with yet another embodiment of the present invention, and as shown in FIG. 3 of the drawings, a petroleum wax separation process and system includes an evaporative cooling (auto refrigeration) step to develop a cold cosolvent which is added to the feedstock/solvent/cosolvent slurry to reduce the temperature of the slurry prior to filtration. The petroleum wax separation process is generally designated by the reference numeral 50 and shown to include a waxy feedstock input line 52, a solvent input line 54, and a cosolvent input line 56. The feedstock is added at about its pour point (120°–150° F.) and mixed with solvent at about ambient temperature to produce a feedstock/solvent mixture which passes along line 58 at a temperature of about 90° F. Cosolvent at about 40°–45° F. is added to the feedstock/solvent mixture to form a feedstock/solvent/cosolvent slurry which passes along a line 60. Evaporative cooling is accomplished using an auto refrigeration system including control valve 62, an adiabatic flash tank 64, a vacuum pump 66, a condenser 68, and a return line 70 which recycles vacuum gas and cold cosolvent upstream of control valve 62.

Although as shown in FIG. 3, cosolvent is evaporated to perform the desired evaporative cooling (auto refrigeration), it is to be understood that when using a solvent and cosolvent combination in which the solvent is lighter than the cosolvent, it would be solvent which is evaporated and recycled. For example, using MEK as a solvent and toluene as a cosolvent, it is the toluene which is evaporated and recycled during evaporative cooling. However, when using MTBE as a solvent and methanol as the cosolvent, it is MTBE which is evaporated (cooled) and recycled during evaporative cooling.

Using an inert gas such as nitrogen as the vacuum gas, vacuum pump 66 draws a vacuum on adiabatic flash tank 64 causing evaporation of a selected quantity of cosolvent with the evaporation causing a desired reduction in temperature of the slurry within the flash tank 64. Although condenser 68 is shown downstream of vacuum pump 66 it is to be understood that the condenser 68 may be located upstream, that is ahead of the vacuum pump 66 in order to liquefy the cosolvent, and, as such, reduce the size of the vacuum pump necessary to accomplish the evaporative cooling. In the condenser 68, the evaporated cosolvent may be reduced to liquid and chilled to, for example, 10° F. This cold cosolvent passes along line 70 and is added to the feedstock/solvent/cosolvent slurry to further reduce the temperature of the slurry prior to entering flash tank 64. A pump 72 pumps cold slurry from the flash tank 64 to a vacuum filter unit 74.

The evaporative cooling (auto refrigeration) of the feedstock/solvent/cosolvent slurry enhances wax precipitation and filtration. The wax output of vacuum filter unit 74 passes along line 76 to a holding tank or wash receiver 78. The wax output 76 of vacuum filter 74 contains a high percentage of liquid, for example, fifty percent solvent/cosolvent. Some of the wash from tank 78 is pumped by pump 80, transferred along line 82, and added to the feedstock/solvent/cosolvent slurry upstream of control valve 62. The wash is added to the slurry stream to cool the slurry stream and, also, to adjust the solids content or dilute the slurry. The wash in line 82 is at about 30°–40° F. and is a low oil content filtrate, made up mainly of solvent and cosolvent.

Wax is output from holding tank 78 alone a line 84. This wax may be further processed for solvent recovery such as in flash evaporation or distillation apparatus. A portion of the wash in holding tank 78 is transferred via line B6 and combined with the filtrate from vacuum filter 74 in line 88. The wash and filtrate in line 88 passes to a holding tank 90 having a liquid (filtrate) output 91 and a gas output 92. The liquid output 91 is pumped by fluid pump 93 and combined with a liquid output 94 of a separator 95. The combined liquid (filtrate) outputs 91 and 94 are sent to solvent recovery for recovering and recycling the solvent and cosolvent and for removing the oil therefrom. The gas output 92 of holding tank 90 passes through a vacuum pump 96 and a condenser 97 upstream of the separator 95. A vacuum gas output 98 of separator 95 is returned to filtrate line 88. Although only a single stage adiabatic flash and single filtration stage are shown in the embodiment of FIG. 3, it is to be understood that sequential flashes and filtrations may be used. In the solvent recovery stage the solvent splitter can be either direct distillation or heat pump distillation.

EXAMPLE 5

Medium neutral raffinate was mixed with 0.75 parts toluene and 2.5 parts acetone. The temperature of the mixture was reduced by applying twenty-five inHg vacuum and $N_2$ stripping. As a result of the acetone evaporation, the temperature was reduced to 15° F. The slurry was filtered to produce a wax cake and a filtrate. The filtrate was stripped of solvents. and the pour point of the oil was 0° F.

Figure 4:
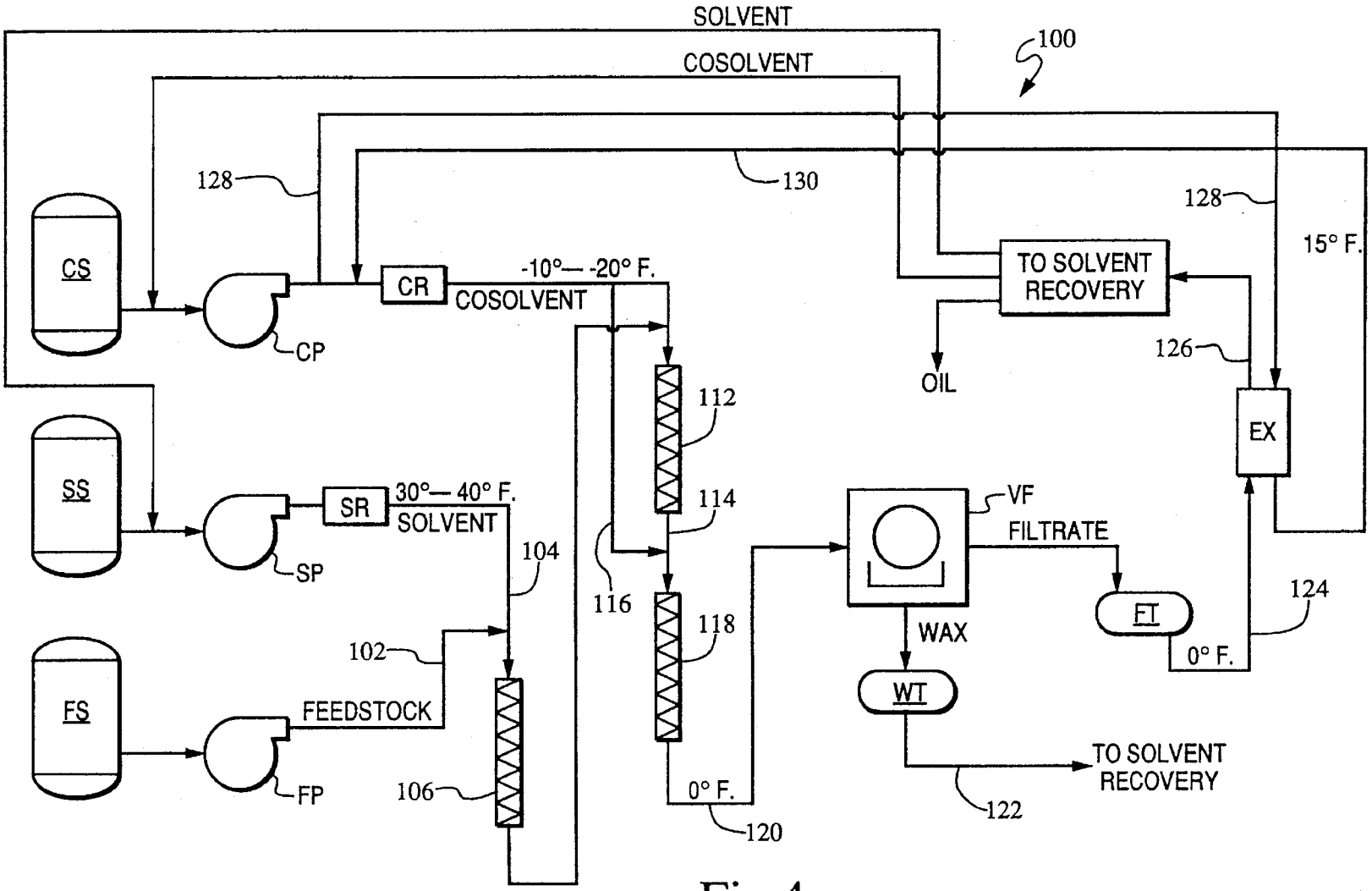
FIG. 4 is a schematic representation of apparatus and process of petroleum wax separation involving cold solvent injection according to still another embodiment of the invention.

As shown in FIG. 4 of the drawings and in accordance with a cold solvent injection dewaxing (dilution chilling) embodiment of the present invention, a dewaxing process and system is generally designated by the reference numeral 100 and shown to include waxy feedstock, solvent, and cosolvent supplies FS, SS, and CS, and fluid pumps FP, SP, and CP. The solvent is passed through a solvent refrigeration unit SR to reduce the temperature of the solvent to about 30°–40° F. Likewise, the cosolvent is passed through a cosolvent refrigeration unit CR to reduce the temperature of the cosolvent to between −10° to −20° F. Waxy feedstock in a line 102 is added to the relatively cold solvent in a line 104 and mixed in a first static mixer 106.

The feedstock/solvent mixture output of static mixer 106 passes along a line 108 to be mixed with cold cosolvent in a line 110 in a second static mixer 112. The feedstock/solvent/cosolvent slurry output of static mixer 112 passes along a line 114 and is mixed with additional cold cosolvent from a line 116 in a third static mixer 118. The slurry output of static mixer 118 passes along a line 120 to vacuum filter unit VF. The wax cake output of filter unit VF passes to a wax holding tank WT and is output along a line 122 to solvent recovery such as a distillation system. The filtrate output of the vacuum filter VF passes to a filtrate holding tank FT, along a line 124 to a cross flow heat exchanger EX, and then along a line 126 to oil, solvent and cosolvent separation and recovery.

The heat exchanger EX utilizes the cold filtrate (about 0° F.) to precool the solvent or cosolvent ahead of the solvent and cosolvent refrigeration units SR and CR, respectively. In the embodiment shown in FIG. 4, cosolvent from cosolvent supply CS passes along a line 128 to the heat exchanger EX so as to be cooled by the cold filtrate passing through the exchanger. Cold cosolvent travels along line 130 to be added to the cosolvent supply upstream of the cosolvent refrigeration unit CR and thereby reduces the energy requirement of the cosolvent refrigeration unit and facilitates cooling of the cosolvent.

EXAMPLE 6

Two hundred parts of a waxy heavy vacuum gas oil (feedstock) at about 120° F. is mixed with four hundred parts of cold toluene (solvent) at about 30° F. to form a homogeneous solution at about 78° F. (25.6° C.). In a first stage, seventy-five parts of acetone (cosolvent) at about −20° F. is added to precipitate a high melt fraction of wax crystals. The mixture is filtered by vacuum filtration and the wax cake product is washed with forty parts of a toluene/acetone mixture having a ratio of toluene/acetone of 5:1.

EXAMPLE 7

One part medium neutral raffinate feedstock having a pour point of 112° F. is mixed with one part cold MTBE (30° F.). As a result of the addition of cold MTBE wax crystals are formed and the slurry is fed to a second mixer where cold methanol (−10° F.) is added in a quantity of 0.5 parts. The slurry is filtered at 15° F. and the filtrate is stripped of solvents by vaporization producing an oil with a pour point of 10° F. The wax is stripped of all solvents by vaporization and a wax with a congeal of 121° F. is obtained.

Figure 5:
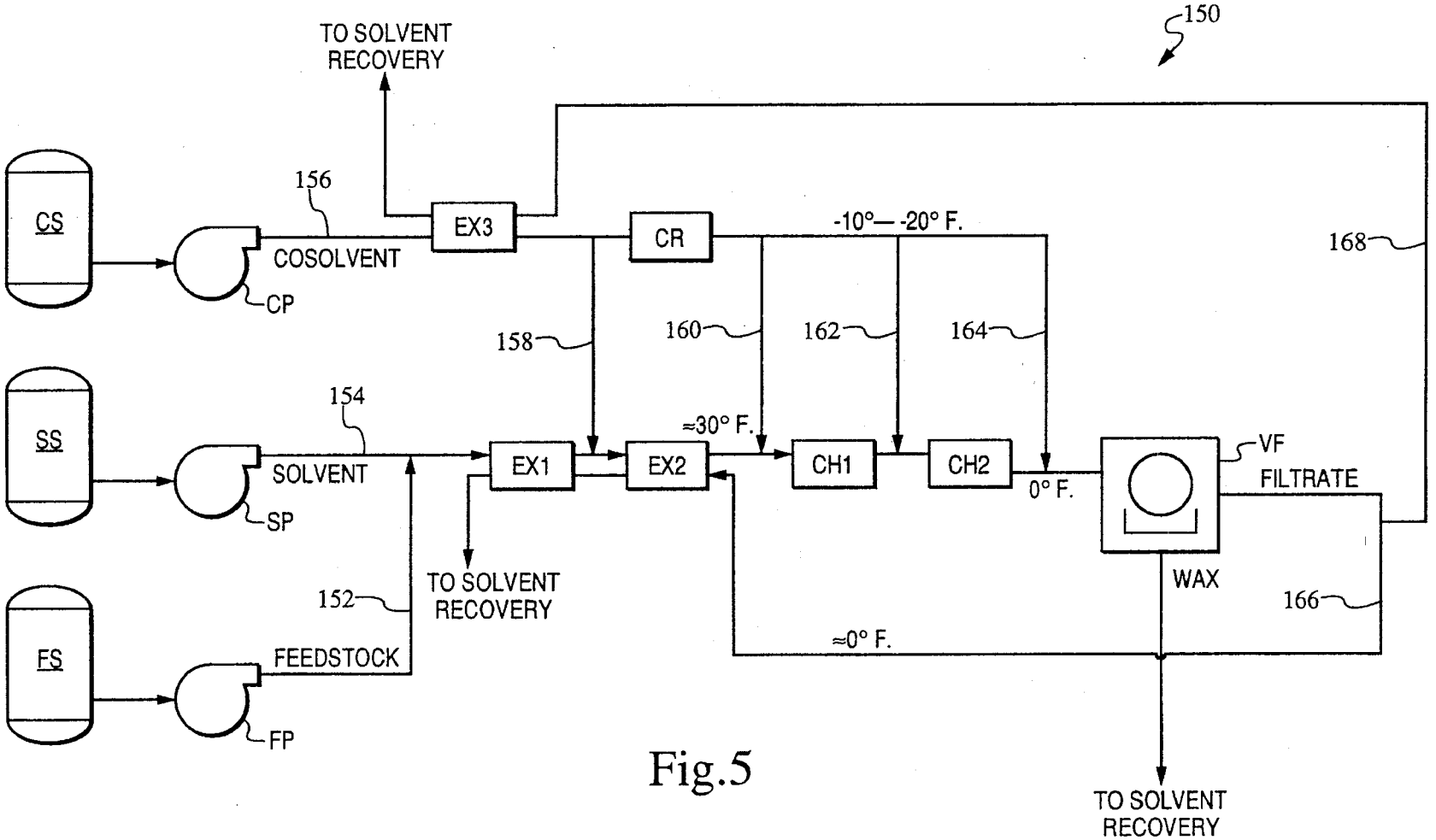
FIG. 5 is a schematic illustration of apparatus and process of petroleum wax separation including incremental cosolvent addition according to still yet another embodiment of the invention.

In accordance with an incremental dilution dewaxing embodiment of the present invention as shown in FIG. 5 of the drawings and generally designated by the reference numeral 150, a waxy feedstock travels along a line 152 and is mixed with a primary solvent in line 154 at or below ambient temperature. The primary solvent, for example MTBE, ETBE, TAME, or dimethyl carbonate, may contain some cosolvent contamination, up to twenty-five percent with some cosolvents. The solvent/feedstock mixture is cooled by cross-exchanging with cold filtrate in scraped-surface heat exchangers EX1 and EX2. Ambient or below ambient temperature cosolvent passes alone a line 156 to a heat exchanger EX3 wherein it is cooled by cross-exchange with cold filtrate. Prior to the solvent/feedstock mixture being chilled in heat exchanger EX2 to 35° F. or below, a quantity of cool cosolvent (40°–50° F.) in line 158 is added to act as an antifreeze and prevent the formation of ice crystals. The resultant solvent/feedstock/cosolvent slurry is chilled in exchanger EX2 to about 30° F. by cross-exchanging with cold filtrate.

At about 30° F. the efficiency of cross-exchanging is reduced to the point where it is more economical to reduce the temperature further by other means. A cosolvent refrigeration unit CR is used to further reduce the temperature of the cool cosolvent to about −10° to −20° F., this cold cosolvent is incrementally added to the solvent/feedstock/cosolvent slurry along lines 160, 162, and 164. Scraped-surface chillers CH1 and CH2 further reduce the temperature of the solvent/feedstock/cosolvent slurry to about 0° F. When the desired filter temperature is reached, the slurry is filtered in vacuum filter VF. The filter temperature is generally about 20° F. above the desired pour point of the oil product. The wax output of vacuum filter VF contains a relatively large quantity of moisture and as such is sent to solvent recovery. The cold filtrate output of vacuum filter VF travels along lines 166 and 168 to exchangers EX1, EX2, and EX3 to serve as a source of cold fluid so as to reduce the energy requirements of the dewaxing process and facilitate cooling of the cosolvent, solvent/feedstock mixture and solvent/feedstock/cosolvent slurry. The filtrate output of exchangers EX1 and EX3 is sent to oil, cosolvent and solvent recovery.

EXAMPLE 8

One part medium neutral raffinate was mixed with one part cold (20° F.) MTBE. The mixture temperature was further reduced to 25° F. by solid surface chilling. The chilled mixture was filtered at 25° F. and a resulting oil had a pour point of 30° F.

EXAMPLE 9

One part medium neutral raffinate was mixed with 1.25 parts cold (40° F.) MTBE. The mixture temperature was reduced to 40° F. by solid surface exchange (freezer). Cold ethanol (0° F.) was added equal to 1.5 parts. The resulting mixture was chilled further to 0° F. and filtered. The oil had a pour point of 7° F.

EXAMPLE 10

One part medium neutral raffinate was mixed with one part MTBE. The mixture was cooled to 40° F. by solid surface chilling and then two parts cold ethanol (0° F.) were added. The resulting 20° F. mixture was filtered and the oil had a pour point of 8° F.

EXAMPLE 11

One part medium neutral raffinate wax mixed with 1.25 parts cold (40° F.) MTBE. The mixture temperature was further reduced to 40° F. by solid surface exchange. The 40° F. solvent/feedstock mixture was mixed with 0.5 parts cold (0° F.) methanol. The resulting solvent/feedstock/cosolvent slurry was at a temperature of 32° F. The slurry was filtered and an oil with a pour point of 20° F. was produced.

EXAMPLE 12

One part medium neutral raffinate was mixed with 1.25 parts cold (40° F.) MTBE. The raffinate/MTBE mixture was cooled to 40° F. and mixed with 0.5 parts cold (0° F.) methanol. The resulting slurry was chilled further to 0° F. by solid surface exchange and filtered. An oil with a pour point of −8° F. was produced.

Figure 6:
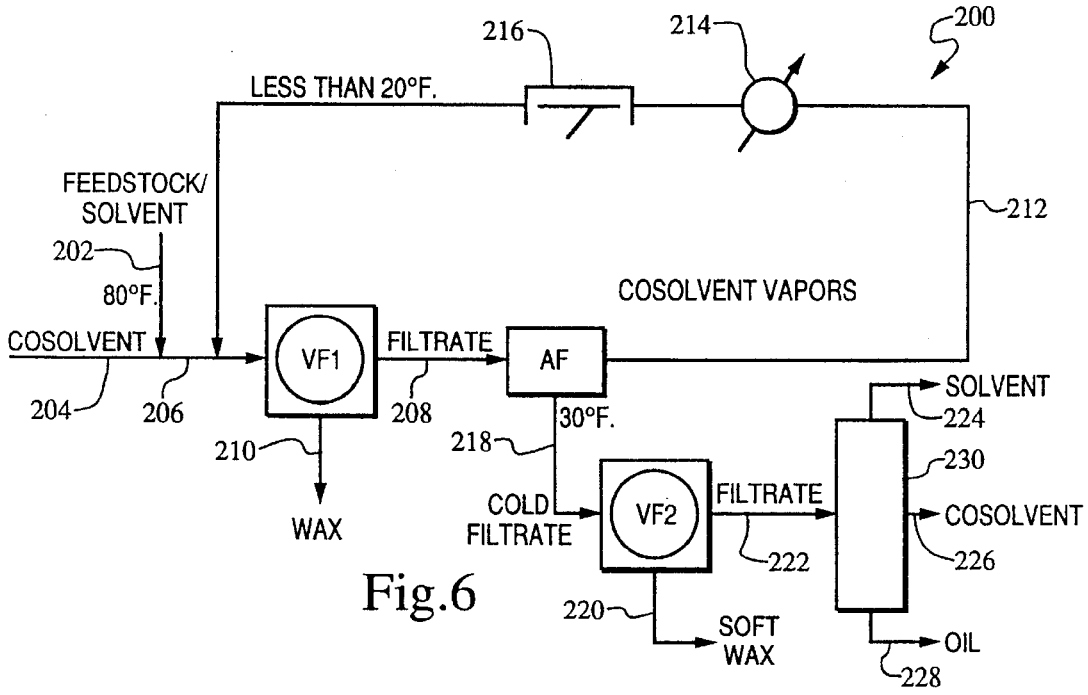
FIG. 6 is a schematic representation of apparatus and process of petroleum wax separation with evaporative cooling in accordance with a different embodiment of the invention.

As shown in FIG. 6 of the drawings, and in accordance with an exemplary wax fractionation embodiment involving evaporative cooling (auto refrigeration), the apparatus and process is generally designated by the reference numeral 200 and shown to include a solvent/feedstock mixture input 202 and a cosolvent input 204. The solvent/feedstock mixture and cosolvent are mixed to form a solvent/feedstock/cosolvent slurry which travels along a line 206 to a first vacuum filter VF1.

The vacuum filter VF1 produces a filtrate output along a line 208 and a hard wax output at 210. The hard wax product is sent to solvent recovery. The filtrate output of vacuum filter VF1 travels to an adiabatic flash tank AF where a sufficient quantity of cosolvent is evaporated to cause a reduction in temperature of the filtrate to about 30° F. Cosolvent vapors from the adiabatic flash tank AF travel along a line 212 and pass through a condenser 214 and a vacuum pump 214 before being added to the solvent/feedstock/cosolvent slurry in line 206. The cold cosolvent (less than 20° F.) being added to the slurry in line 206 reduces the temperature of the slurry and facilitates the precipitation and removal of hard waxes.

The cold liquid (filtrate) output of adiabatic flash tank AF passes along a line 218 to a second vacuum filter VF2. The second vacuum filter VF2 produces a soft wax product at 220 and a filtrate at 222. The soft wax in line 220 is sent to, for example, a holding tank and thereafter to solvent recovery. The filtrate in line 222 is separated in a separator 230 into solvent, cosolvent, and oil product streams 224, 226, and 228.

Although the embodiment shown in FIG. 6 is directed to the evaporation of cosolvent, it is to be understood that when using a solvent which is lighter than the cosolvent, it would be the solvent which is evaporated and accomplishes the desired reduction in temperature of filtrate. Also, even though the embodiment shown in FIG. 6 is a dual stage or two stage filtration process, it is to be understood that additional sequential filtrations and adiabatic flashes may be added so as to provide for three or more wax fractionation and evaporative cooling stages.

EXAMPLE 13

One part medium neutral raffinate was mixed with 0.75 parts toluene and 3.0 parts acetone. The mixture temperature was reduced to 20° F. by twenty-five inHg vacuum. The filtrate oil was stripped with the oil produced having a pour point of 5° F.

EXAMPLE 14

One part medium neutral raffinate was mixed with one part MTBE and 0.5 parts ethanol. The mixture temperature was reduced to 30° F. by applying a twenty-five inHg vacuum. 0.5 parts of 30° F. MTBE were added back to the mixture to account for the lost MTBE (evaporated) and the slurry was filtered at 30° F. The resulting oil had a pour point of 22° F.

Figure 7:
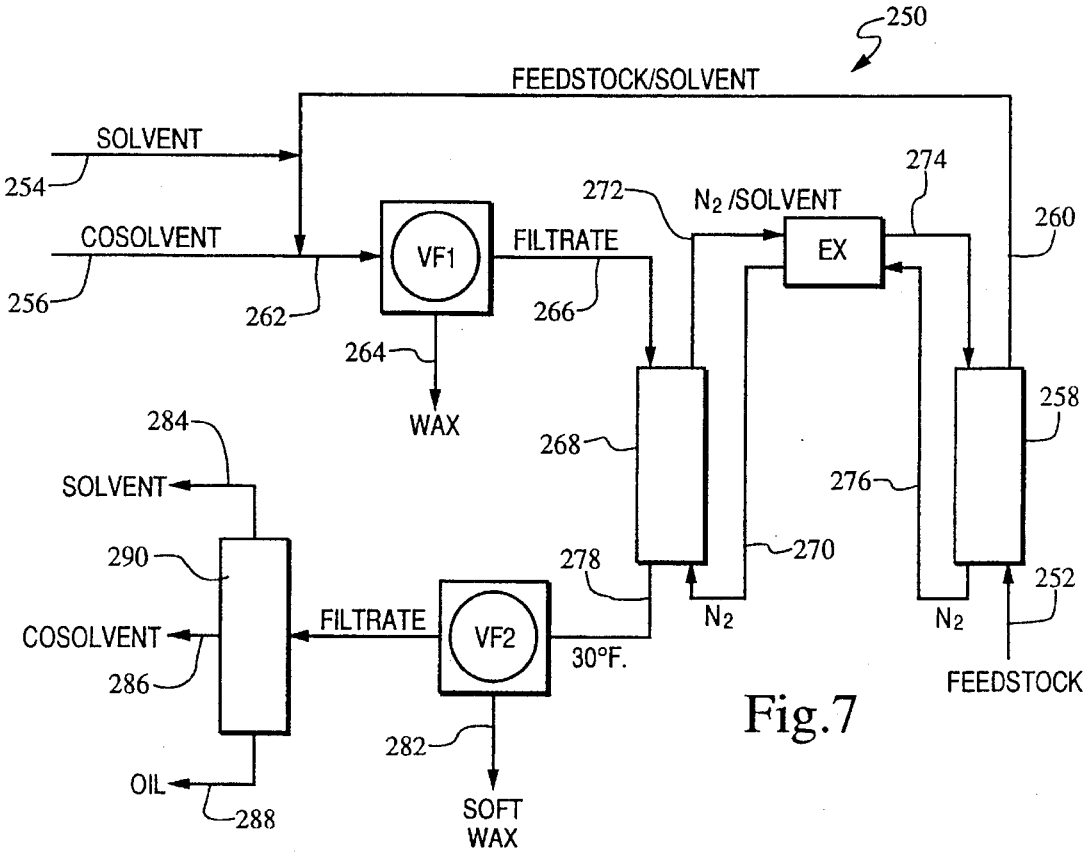
FIG. 7 is a schematic illustration of apparatus and process of petroleum wax separation including evaporative cooling in the form of absorptive cooling or stripping in accordance with another embodiment of the invention.

As shown in FIG. 7 of the drawings and in accordance with another wax fractionation embodiment of the present invention involving adiabatic inert gas stripping, the apparatus and process is generally designated by the reference numeral 250 and shown to include a waxy feedstock input line 252, a solvent input line 254 and a cosolvent input 256. The waxy feedstock In line 252 passes through a feedstock supply tank 258 where it picks up solvent from a nitrogen/solvent stream as will be described later.

The feedstock/solvent mixture travels alone a line 260 where it is combined with additional solvent from line 254 and cosolvent from line 256. The resultant feedstock/solvent/cosolvent slurry travels along a line 262 to a first vacuum filter VF1. The vacuum filter VF1 has a wax product output 264 and a filtrate output 266. The wax (hard wax) product is sent to solvent recovery. The filtrate in line 266 travels to an inert gas stripper or absorption tower 268 which in this case is an adiabatic nitrogen stripper which strips a small quantity of solvent from the filtrate and thereby reduces the temperature of the filtrate down to 30° F. Thus, evaporative cooling is accomplished by inert gas stripping or absorptive cooling of the filtrate using nitrogen.

Nitrogen in a line 270 enters the base of the absorption tower 268 and exits from the top of the tower carrying with it some of the solvent. The nitrogen and stripped or absorbed solvent travel alone a line 272 to a heat exchanger EX and exit the exchanger through line 274 which leads to the feedstock tank 258. The inert gas (nitrogen) exits the tank 258 via a line 276 which leads to the exchanger EX.

Cold filtrate exits the stripper tower 268 via a line 278 which extends to a second vacuum filter VF2. The second vacuum filter VF2 has a filtrate product output line 280 and a soft wax product output line 282. The soft wax product is sent to solvent recovery. The filtrate in line 280 is separated into solvent, cosolvent and oil product streams 284, 286 and 288, by a separator 290, for example by a distillation column. Although the embodiment in FIG. 7 is shown to include only two filtration stages, it is to be understood that the present invention is adaptable to numerous filtrations, and as such, provides a wax fractionation process which may produce multiple grades of wax. Also, it is contemplated that stripper gases other than nitrogen may be used.

The wax fractionation embodiments shown in FIGS. 6 and 7 of the drawings are especially adapted for the production of lube oil from a waxy feedstock such as slack wax.

With reference again to FIGS. 6 and 7 of the drawings, in the flash tank and absorption tower where the filtrate cooling takes place only a relatively small amount of solvent or cosolvent is evaporated to achieve a 30° F. outlet temperature.

EXAMPLE 15

In accordance with one example of the present invention where one pound of oily feedstock is mixed with two pounds of methanol and one-half pound of toluene at 85° F. and contacted with 1.85 pounds of nitrogen gas in an adiabatic absorber, 0.2 pounds of methanol (or 10% of the methanol feed) is vaporized resulting in a final liquid temperature of 29° F. After filtering the wax crystals and recovering the solvents from the filtrate, a lube oil with a 0° F. pour point is produced.

The dewaxing process of the present invention provides for the production of high normal paraffin content waxes having a normal paraffin content of 90% or greater.

EXAMPLE 16

A cut of a heavy vacuum gas oil is added to one part MTBE and 0.5 parts ethanol. The slurry is filtered at 75° F. and the wax is stripped of all solvents by vaporization. A wax yield of 24% is obtained having a content of 98% normal paraffin and 2% isoparaffin and other constituents.

In accordance with another aspect of the present invention, the deoiled wax cake from the dewaxing process is "fractioned" to produce a hard, high melting point wax and a soft wax. This method of fractioning involves the addition of warm solvent (with little or no cosolvent contamination) at a temperature suitable to give a desired resulting slurry temperature. The addition of warm solvent causes the soft wax to go back into solution and leaves the hard wax as crystals. The resulting slurry is then filtered and the filtrate is stripped of solvents to produce soft wax. The hard wax cake is then stripped of solvents to produce a hard wax. The amount of solvent added to the wax cake will be such that the overall wax/solvent ratios will be essentially those described above when using slack wax feeds.

In accordance with yet another embodiment of the present invention, in general, the wax cake from the filter in the dewaxing operation contains 50–75% moisture (solvents and oil). About 25–30% of this moisture may be oil. To produce a better wax product and a higher oil yield, the moist wax cake is deoiled. Additional cosolvent is added to the moist wax cake in a quantity of about 1:1 or 2:1 based on the particular wax cake and the oil is rinsed from the wax cake. The resulting slurry is refiltered and the low oil wax product is either stripped of solvents or fractioned in a wax fractionation step. The filtrate which is cold and contains some oil may be used as dilution solvent in the dewaxing step.

EXAMPLE 17

A waxy vacuum gas oil having an 80 percent boiling point of 700° F. is deoiled using 1 part MTBE (solvent) to feed (waxy vacuum gas oil) followed by 1.5 parts anhydrous ethanol (cosolvent). Upon the addition of the ethanol wax begins to crystallize. The feed/solvent/cosolvent/wax slurry is filtered at 75° F. and the wax cake is washed with a volume of wash solution containing 20 percent MTBE and 80 percent ethanol. The wax is stripped of solvents. The final wax product has a congealing point of 120° F. with 98.7 percent normal paraffin content, 81 percent of which is between $C_{22}$ and $C_{25}$, an oil content of less than 0.05 percent, and a melting point range of less than plus or minus three °F.

EXAMPLE 18

A waxy vacuum gas oil (feed) having a 50 percent boiling point of 720° F. is deoiled with 1.5 parts MTBE (solvent) followed by 4 parts anhydrous ethanol (cosolvent). The feed/solvent/cosolvent/wax slurry is filtered at 75° F. to produce a wax and a filtrate. The wax is washed with a volume of wash solution containing 20 percent MTBE and 80 percent ethanol. The solvents are removed from the wax producing a wax with a 120° F. congealing point, containing 97.2 percent normal paraffin, 82 percent of which is between $C_{24}$ and $C_{27}$, an oil content of less than 0.05 percent, and a melting point range of less than plus or minus two °F.

EXAMPLE 19

A waxy vacuum gas oil (feed) having a 50 percent boiling point of 800° F. is deoiled with 2 parts MTBE (solvent) followed by 2.5 parts ethanol (cosolvent). The feed/solvent/cosolvent/wax slurry is filtered to produce a wax and a filtrate. The wax is washed with a solution containing 20 percent MTBE, 80 percent ethanol. The wax is stripped of solvents yielding a final wax with a congealing point of 138° F., containing 96.5 percent normal paraffins, with eighty one percent of the paraffins between $C_{26}$ and $C_{29}$, an oil content of less than one percent, and a melting point range of less than plus or minus one °F.

EXAMPLE 20

Example of deoiling a slack wax: twenty parts of a slack wax (feed) having an oil content of approximately 10 percent are mixed with forty parts of toluene (solvent) and heated gently to obtain a homogeneous solution. The mixture is then allowed to cool to 78° F. (28.6° C.). Fifty-five parts of acetone (cosolvent) are added and within minutes a precipitate forms. The mixture is filtered to collect a wax cake. The wax cake is washed and solvents removed to produce a wax product having an oil content of less than one percent, a congealing point of about 182° F., a normal paraffin content of at least 95 percent with at least 80 percent having a carbon distribution of less than 4.

EXAMPLE 21

A cut of a heavy vacuum gas oil is added to one part cold MTBE and then 0.5 parts ethanol. The resultant slurry is filtered at 75° F. and the wax is stripped of all solvents by vaporization. A wax yield of 24% is obtained having a content of 98% normal paraffin and 2% iso-paraffin and other constituents with at least 80 percent of the normal paraffins having a carbon distribution of 3 or less.

In accordance with still yet another aspect of the present invention, the primary solvents (tertiary ethers, such as MTBE, ETBE, and TAME and/or dimethyl carbonate) and alcohol cosolvents can be used in conjunction with a conventional cold solvent injection process for dewaxing waxy feedstocks. For example, in a conventional cold solvent injection process (dilution chilling) a solvent such as MEK (methyl ethyl ketone) or a mixture of solvents such as MEK and toluene is chilled and added to a waxy feedstock in a mixture or series of mixtures. As a result of the cold solvent addition, wax crystals form. The resulting slurry is filtered immediately or may have its temperature further reduced by being chilled in a scrape surface chiller prior to filtration.

EXAMPLE 22

One part medium neutral raffinate feedstock having a pour point of 112° F. is mixed with one part cold ETBE (30° F.). The mixture is fed to a second mixer where cold propanol (−10° F.) is added in a quantity of 0.5 parts. The slurry is filtered at 15° F. and the filtrate is stripped of solvents by vaporization producing an oil with a pour point of 10° F. The wax is stripped of all solvents by vaporization and a wax with a congeal of 121° F. is obtained.

In accordance with the present invention, a waxy feedstock is first mixed with a primary solvent (MTBE, ETBE, TAME, or dimethyl carbonate) at or below ambient temperature. The solvent may contain some cosolvent contamination, up to 25% depending on the cosolvent chosen. The solvent/feedstock mixture is then mixed with cosolvent at or below ambient temperature in a single mixer or series of mixers. As a result of the cosolvent addition, wax crystals form. The resulting slurry is either filtered immediately, or has its temperature reduced further by being chilled in scrape surface chillers prior to filtration.

The solvent/feedstock/cosolvent slurry is filtered at a temperature sufficient for producing an oil with the desired pour point. The required filter temperature is generally 5°–20° F. above the desired pour point of the oil. In order to reduce the refrigeration requirements, the cold filtrate may be cross-exchanged with the primary solvent or cosolvent prior to the refrigeration unit.

Typically, the lube plant is the slowest step (bottleneck) in the refinery process, therefore, if one can speed up the lube plant process one can speed up the whole refinery process, and, as such, reduce cost and maximize the profit potential of the refining process. The wax petroleum separation process of the present invention provides a means for speeding up the lube plant process, and, thereby, provides a means for debottlenecking conventional refinery processes.

An added advantage of using an alcohol as a selected cosolvent is that the alcohol serves as an antifreeze to keep ice from forming in the solvent/feedstock/cosolvent slurry. The formation of ice reduces the filtration efficiency of the vacuum filtration units and, also, causes deterioration of conventional scrape surface exchangers. Thus, the use of an alcohol cosolvent will serve to increase filtration efficiency and increase the effective life of scrape surface exchangers. Also, alcohol cosolvents require the use of less primary solvent, and, as such, increase overall plant capacity and reduce cost. The less solvent and cosolvent that must be added to the waxy feedstock, the greater the amount of feedstock that can be dewaxed given a fixed plant capacity. Still further, the use of alcohol cosolvents allows for steam stripping to accomplish the evaporative cooling of the filtrate. As such, one would not need to use nitrogen to strip the cosolvent from the filtrate and cause evaporative cooling. As much as conventional dewaxing systems already incorporate the use of steam, alcohol cosolvents are especially adapted for use with conventional systems.

The preferred primary solvents MTBE, TAME, and ETBE are all tertiary ethers which have a conventional use as gasoline additives or octane enhancers, and each of which have at least five carbon atoms, at least twelve hydrogen atoms, and at least one oxygen atom per molecule, and, as such, are oxygenated organic compounds. The other preferred primary solvent is dimethyl carbonate, a carbonic acid dimethyl ester, belonging to a class of compounds (organic acid esters) having at least three carbons, at least one oxygen, and at least three non-hydrocarbon atoms per molecule (oxygenated organic compounds). Generally, carbonic acid esters have a chemical formula $(R)_2$ CO except for ethyl methyl ester, which has a formula $R_1$—CO—$R_2$. Tertiary ethers, dimethyl carbonate, and alcohols are all environmentally compatible in that they are oxygenated organic compounds as compared with conventional solvents, such as, MEK, toluene, and acetone.

With respect to TABLES I–X, TABLE I provides a comparison of a basic solvent/cosolvent/dewaxing (deoiling) process of the present invention with a conventional single stage mixed solvent, MEK/toluene process. The basic solvent/cosolvent/dewaxing process was a batch-type process wherein solvent was added to the waxy feedstock to form a homogeneous mixture, then cosolvent was added, wax precipitated and removed, and the wax washed with a mixture of solvent and cosolvent. TABLES II–V show the results of dewaxing (deoiling) different waxy feedstocks using a batch-type solvent/cosolvent/dewaxing process in accordance with the present invention. TABLES VI and VII provide equations for the effect of temperature on filtration rate and viscosities. TABLE VIII provides calculated mixture viscosities. TABLE IX illustrates calculated equilibrium temperatures. TABLE X represents information regarding some primary solvents.

Thus, it will be appreciated that as a result of the present invention a highly effective petroleum wax separation apparatus and method is provided by which the principal objective among others is completely fulfilled. It is contemplated and will be apparent to those skilled in the art from the preceding description and accompanying drawings that modifications and/or changes may be made in the illustrated embodiments without departure from the present invention. For example, it is contemplated that in the illustrated embodiments the waxy feedstock supply or input to the process may contain solvent, and, as such, be a feedstock/solvent mixture with little or no cosolvent contamination. Accordingly, it is expressly intended that the foregoing description and accompanying drawings are illustrative of preferred embodiments only, not limiting, and that the true spirit and scope of the present invention be determined by reference to the appended claims.

TABLE I

Comparison of Solvent/Cosolvent Deoiling Process with Single Stage MEK/Toluene Process using MINAS 650–910° F. Cut

| Process Conditions | |
|---|---|
| MEK/Toluene: | |
| Solvent: | MEK/Toluene |
| Solvent ratio: | 3/1 |
| Wash: | MEK/Toluene |
| Wash ratio: | 5/1 |
| Filter Temperature: | 30–35° F. |
| Solvent/Cosolvent: | |
| Solvent: | toluene |
| Solvent ratio: | 1.5/1 |
| Cosolvent: | acetone |
| Cosolvent ratio: | 1.0/1 |
| Wash: | acetone/toluene |

TABLE I-continued

| Comparison of Solvent/Cosolvent Deoiling Process with Single Stage MEK/Toluene Process using MINAS 650–910° F. Cut | |
|---|---|
| Wash ratio: | 5.0/1 |
| Filter Temperature: | 75° F. |
| Wax Inspections | |
| MEK/Toluene: | |
| Yield: | 38.5% |
| Congealing Point: | 140° F. |
| Oil Content: | 0.83% |
| Penetration 100° F.: | 12 |
| Solvent/Cosolvent: | |
| Yield: | 30.0% |
| Congealing Point: | 145° F. |
| Oil Content: | 0.02% |
| Penetration 100° F.: | 8 |
| Filtrate Oil Inspections | |
| MEK/Toluene: | |
| Pour Point: | +55° F. |
| Solvent/Cosolvent: | |
| Pour Point: | +80° F. |

TABLE II

Deoiling Results of Waxy Vacuum Distillate (1) 650–910° F. Cut

| | Run 1 | Run 2 | Run 3 |
|---|---|---|---|
| Feed Conditions | | | |
| Solvent: | toluene | toluene | toluene |
| Solvent/Feed: | 1.5 | 0.7 | 0.7 |
| Cosolvent: | acetone | acetone | acetone |
| Cosolvent/Feed: | 1.0 | 1.5 | 1.0 |
| Temperature: | 75° F. | 75° F. | 75° F. |
| Wax Inspections | | | |
| Yield on Feed: | 8.3 | 26.8 | 24.4 |
| Yield on Wax In Feed: | 52.6 | 47.9 | 43.17 |
| Congealing Point °F.: | 148 | 137 | 138 |
| Oil Content, Wt %: | 0.81 | 1.03 | 0.02 |
| Gravity, API: | 41.1 | 41.8 | 4.1.4 |
| Viscosity @ 210° F.: | 4.943 | 4.10 | 3.99 |
| Needle Penetration @ 100° F.: | 17 | 31 | 16 |
| Oil Inspections | | | |
| Gravity, API: | 39.8 | 38.9 | 39.4 |
| Pour Point, °F.: | 95 | 80 | 85 |
| Viscosity @ 210° F., cst: | 3.009 | 2.902 | 2.884 |

TABLE III

Deoiling Results of Vacuum Resid

| | |
|---|---|
| Feed Conditions | |
| Solvent: | toluene |
| Solvent/Feed: | 1.5 |
| Cosolvent | acetone |
| Cosolvent/Feed: | 2.0 |
| Temperature: | 75° F. |
| Wax Inspections | |
| Yield on Feed, Wt. %: | 51.4 |
| Congealing Point, °F.: | 189 |
| Oil Content, Wt. %: | 0.13 |
| Gravity, API: | 34.2 |
| Viscosity @ 210° F.: | 26.448 |

TABLE III-continued

Deoiling Results of Vacuum Resid

| | |
|---|---|
| Needle Penetration, 100° F.: | 9 |
| Oil Inspections | |
| Gravity, API: | 34.2 |
| Pour Point, °F.: | 105 |
| Viscosity @ 210° F.: | 16.591 |

TABLE IV

Dewaxing Results of Light Neutral

| | |
|---|---|
| Feed: Light Neutral | |
| API: | 33.5 |
| Pour: | 80° F. |
| Conditions: | |
| Feed: | 1.0 |
| Toluene (Solvent): | 0.75 |
| Acetone (Cosolvent): | 3.2 |
| Wax Product: | |
| Yield %: | 14.9% |
| Congeal: | 115° F. |
| Oil Content: | 13% |
| Oil Product: | |
| Yield: | 85.1% |
| Pour: | 15° F. |
| API: | 31.2 |
| V.I.: | 110 |

TABLE V

Slack Wax Deoiling

| | |
|---|---|
| Stack Wax Feed | |
| Congealing Point: | 131° F. |
| Oil Content: | 2.0% |
| Needle @ 77° F.: | 60 |
| Conditions | |
| Feed: | 1.0 |
| Toluene (Solvent): | 1.5 |
| Acetone (Cosolvent): | 1.0 |
| Wax Product | |
| Yield: | 60% |
| Congeal: | 141° F. |
| Oil Content: | 0.18% |
| Penetration (100° F.): | 38 |
| Secondary Wax | |
| Yield: | 16% |
| Congeal: | 118° F. |
| Oil Content: | 0.7% |

TABLE VI

Effect of Temperature on Filtration Rates filtration rate = driving force/resistance $dv/dt = P * A/(\mu*[a(W/A) + r])$ P = pressure drop across filter?
A = filter area?
$\mu$ = filtrate viscosity
a = specific cake resistance?
W = weight of cake?
r = resistance of filter media?

TABLE VII

Effect of Temperature on Viscosities
$\mu = A * \exp(B/T)$

| T (F) | μ(cs) oil(100N) | acetone | toluene |
|---|---|---|---|
| 0. | 1143. | 0.64 | 1.15 |
| 30. | 375. | 0.50 | 0.89 |
| 50. | 192. | 0.43 | 0.81 |
| 75. | 89. | 0.40 | 0.65 |
| 100. | 44. | — | — |
| 210. | 3.8 | — | — |

TABLE VIII

Calculated Mixture Viscosities
$\mu = \Sigma x_i * \mu_i$
oil x = 0.03
toluene x = 0.12
acetone x = 0.85

| T (F) | μp(cs) |
|---|---|
| 0. | 35. |
| 30. | 12. |
| 75. | 3.1 (5.4 measured) |

TABLE IX

Calculated equilibrium temperatures at several different filtration pressures for a typical toluene/acetone system.

| Filtration Pressure (mmHg) | Calculated Equilibrium Temperature (°F.) |
|---|---|
| 40 | 17 |
| 25 | 3 |
| 15 | −12 |
| 10 | −23 |

TABLE X

Structures of primary solvents
DMC, MTBE, TAME, and ETBE

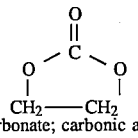

DMC; Dimethylcarbonate; carbonic acid dimethyl ester; $C_3H_6O_3$; $(CH_3O)_2CO$

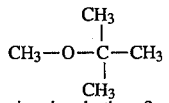

MTBE; methyl tertiary butyl ether; 2-methoxy, 2-methyl propane; $C_5H_{12}O$; $(CH_3)_3C(OCH_3)$

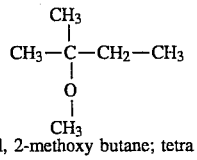

TAME; 2-methyl, 2-methoxy butane; tetra loral amil ether;

TABLE X-continued

Structures of primary solvents
DMC, MTBE, TAME, and ETBE $C_6H_{14}O$

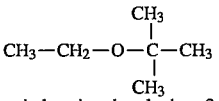

ETBE; ethyl tertiary butyl ether; 2-ethyl; 2-methoxy propane; $C_6H_{14}O$

What is claimed as invention is:

1. A petroleum wax separation process for separating the wax from the oil in a waxy feedstock comprising the steps of:

combining a waxy petroleum feedstock at a temperature at least about its pour point with a carbonic acid ester solvent to form a feedstock/solvent mixture having a pour point temperature below that of the waxy feedstock, adding a cosolvent to the feedstock/solvent mixture to form a feedstock/solvent/cosolvent slurry, said cosolvent being essentially immiscible with the wax at and below the temperature of the feedstock/solvent mixture when the cosolvent is added, essentially immiscible with the oil, miscible with the feedstock/solvent mixture, and significantly miscible with water, and removing wax that precipitates out of the feedstock/solvent/cosolvent slurry.

2. The process as recited in claim 1 wherein said solvent is dimethyl carbonate.

3. The process as recited in claim 1 wherein the cosolvent is an alcohol having three or less carbons.

4. In a solvent oil/wax separation process for dewaxing or deoiling a waxy feedstock including chilling of the solvent, feedstock/solvent mixture, or both, the improvement comprising:

sequentially adding a carbonic acid ester solvent and a cosolvent to the waxy feedstock to form a feedstock/solvent/cosolvent slurry, said cosolvent being essentially immiscible with the wax at and below the slurry temperature, essentially immiscible with the oil, miscible with the solvent, and significantly miscible with water.

5. The process as recited in claim 4 wherein the solvent is dimethyl carbonate.

6. The process as recited in claim 1 wherein said process is a continuous operation with solvent recovery and recycle.

7. The process as recited in claim 1 wherein said feedstock/solvent mixture is a homogeneous single liquid phase solution.

* * * * *